United States Patent [19]

Schulz, Jr.

[11] Patent Number: 4,770,397

[45] Date of Patent: Sep. 13, 1988

[54] SPRING WIRE ELEMENT FOR FOUNDATION UNIT

[75] Inventor: Martin Schulz, Jr., Brenham, Tex.

[73] Assignee: Steadley Company, Carthage, Mo.

[21] Appl. No.: 915,980

[22] Filed: Oct. 6, 1986

[51] Int. Cl.[4] ..... F16F 25/00

[52] U.S. Cl. ..... 267/144; 5/247; 5/250; 267/103

[58] Field of Search ..... 267/103, 104, 105, 106, 267/107, 108, 109, 144; 5/247, 249, 250, 255, 476

[56] References Cited

U.S. PATENT DOCUMENTS

| | | | |
|---|---|---|---|
| 2,568,829 | 9/1951 | Scott et al. | 267/107 |
| 2,843,191 | 7/1958 | Regan | 267/144 X |
| 3,638,254 | 2/1972 | Falkenau | 5/247 |
| 4,489,450 | 12/1984 | Miller | 5/250 |
| 4,595,180 | 6/1986 | Hagemeister | 267/103 |
| 4,654,905 | 4/1987 | Miller | 5/249 |

*Primary Examiner*—Andres Kashnikow
*Assistant Examiner*—Matthew C. Graham
*Attorney, Agent, or Firm*—Lee & Smith

[57] ABSTRACT

A wire support member for a foundation unit. The support member is composed of a continuous, planar wire element, comprising parallel upper and lower attachment segments and a sinuous central segment extending between the upper and lower segments. The central segment is composed of a series of C-shaped curved portions. A series of the support members can be used in rows to form a foundation unit, and the members can be located perpendicular to one another at the corners of a foundation unit in order to form a corner support.

9 Claims, 1 Drawing Sheet

Fig. 1.
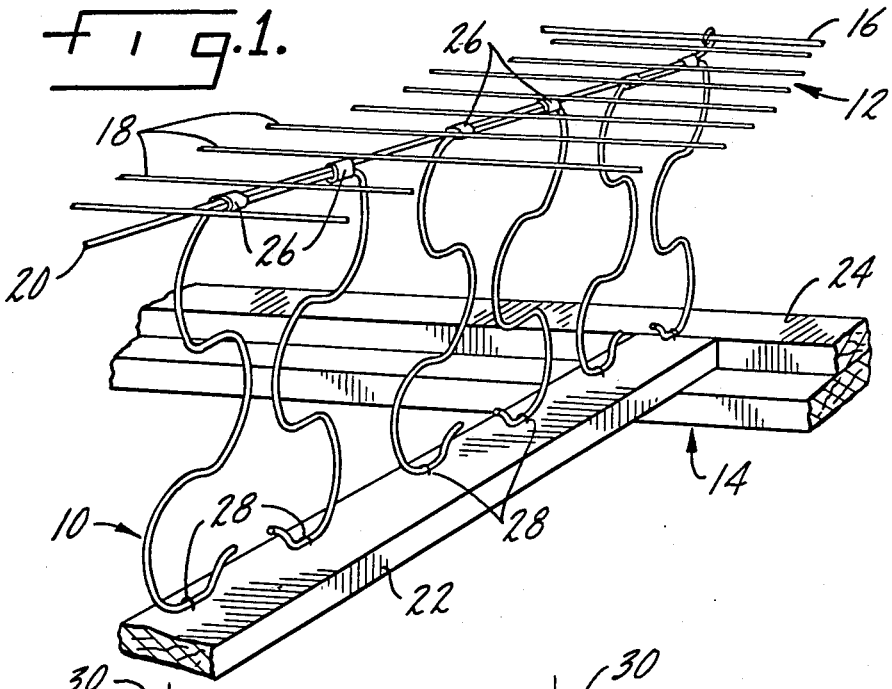
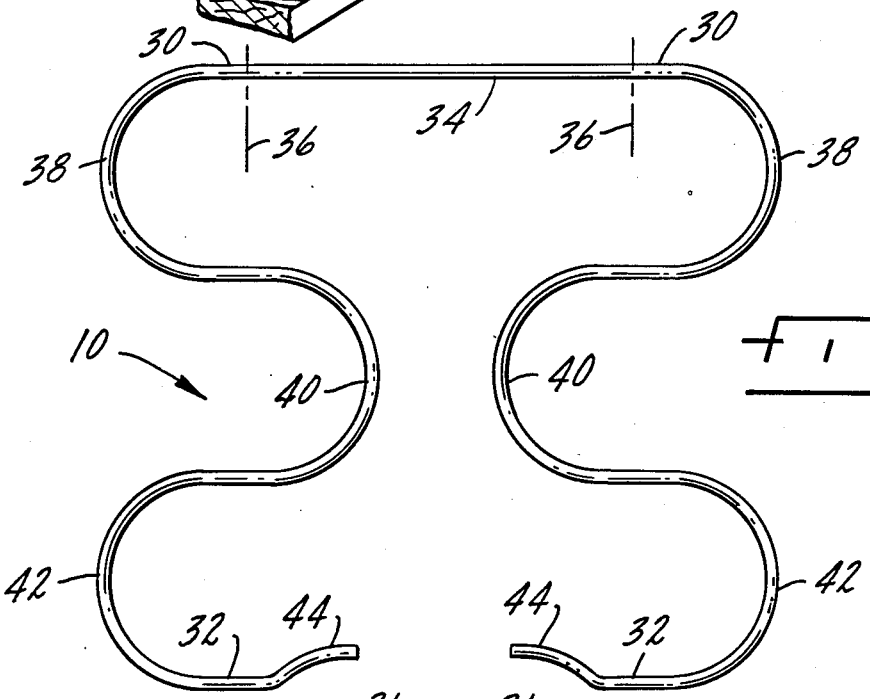
Fig. 2.
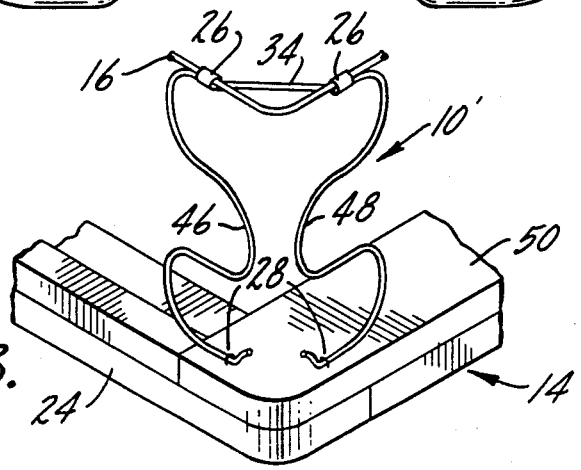
Fig. 3.

SPRING WIRE ELEMENT FOR FOUNDATION UNIT

BACKGROUND OF THE INVENTION

This invention relates to foundation units, and more particularly to a wire support member for a foundation unit having spring characteristics yet permitting a foundation unit to be stored and shipped in a collapsed state and latter elevated to a fully expanded state.

U.S. Pat. No. 4,377,279, assigned to the Assignee of this application, pertains to a foldable steel wire foundation unit such as a boxspring for bedding purposes. The foundation unit is composed of a rigid bottom substructure, a flat top grid structure, and a plurality of spaced, parallel rows of substantially flat support members extending between the grid structure and the bottom substructure. Because the support members are substantially flat and are hingedly secured to the grid structure and the bottom substructure, the foundation unit can be fully assembled in the factory and shipped to the customer in a closed position, with the customer ultimately raising the unit to a fully expanded state and locking the structure in place by means of a plurality of oppositely directed stabilizers in the form of a series of struts. This invention is intended to be an improvement over that disclosed in U.S. Pat. No. 4,377,279, the disclosure of which is incorporated herein by reference.

SUMMARY OF THE INVENTION

The invention provides a wire support member for a foundation unit, the support member being composed of a continuous wire element which comprises parallel upper and lower attachment segments and a sinuous central segment extending between the upper and lower segments. The central segment includes at least a generally C-shaped first curved portion and a recurved generally C-shaped second curved portion extending from the first curved portion. In accordance with the preferred embodiment of the invention, the central segment also includes a generally C-shaped third curved section extending from the second curved section.

For securing of the lower attachment segment to the bottom substructure of a foundation unit or the like, the lower attachment segment includes a leg raised toward the central segment. The leg prevents the lower attachment segment from becoming disengaged from the bottom substructure even under substantial compressive pressures.

Preferably a pair of the wire elements are joined at their upper attachment segments to form a unitary support member. A series of the support members can be located in spaced rows to compose the vertical support portions of a foundation unit. Also, to form a corner support for a foundation unit, a corner element may be formed comprising a pair of the wire elements situated at right angles to one another and located at each corner of the foundation unit. In that situation, the two wire elements of each corner element are connected by a common link which extends at an obtuse angle to each wire element of the corner element. In addition, the elements can be used also as side supports for retaining a foldable steel wire foundation in the expanded state.

BRIEF DESCRIPTION OF THE DRAWINGS

The invention is described in greater detail in the following description of examples embodying the best mode of the invention taken in conjunction with the drawing figures, in which:

FIG. 1 is a partial perspective view of a foundation unit employing a series of wire support members according to the invention, FIG. 2 is an enlarged elevational view of a wire support member of the invention, and FIG. 3 is a perspective view of a wire support member according to the invention when used as a corner element of a foundation unit.

DESCRIPTION OF EXAMPLES EMBODYING THE BEST MODE OF THE INVENTION

The invention comprises a wire support member used typically in a steel wire foundation. Such a foundation is disclosed and described in greater detail in referenced U.S. Pat. No. 4,377,279. It is intended that the wire support members 10 be installed in a foundation or the like which is composed of a rectangular, grid wire top bearing structure 12 and a corresponding rectangular, rigid bottom substructure 14, although it is evident that the wire support members 10 can be used in conjunction with other similar structures.

As is conventional, the grid wire top bearing structure 12 is composed of a perimeter border member 16 and a series of parallel transverse rows 18 and longitudinal columns 20 of grid wires extending between opposed edges of the perimeter border member 16. The grid wires 18 and 20 may be welded to one another at cross points, as is conventional, and may be welded to or wrapped about the perimeter border member 16. The means by which the grid wires 18 and 20 and perimeter border member 16 are affixed to one another forms no part of the invention.

The bottom substructure 14 may also be a conventional construction composed of a series of cross slats 22 (one illustrated) extending between longitudinal sides slats 24. Conventional end slats (not illustrated in FIG. 1) can be used, and the slats may be formed of wood and glued, stapled, nailed or otherwise affixed to one another as desired.

The support members 10 are attached to a foundation unit in a series of parallel rows (one illustrated) between the top bearing structure 12 and the bottom substructure 14. As illustrated in FIG. 1, the tops of the support members 10 may be secured to the grid wires 20 by means of a series of clips 26, while the bottoms of the support members 10 are secured to the cross slats 22 by means of appropriate staples 28. Again, other means of attachment to the grid wire top bearing structure 12 and the bottom substructure 14 may be employed, as desired.

As best shown in FIG. 2, the wire support member 10 is composed of a pair of upper attachment segments 30 and a pair of spaced lower attachment segments 32. A link 34, extending between limits 36 of the segments 30, forms a continuous connection of the segments 30. A sinuous central segment extends between the upper and lower segments 30 and 32, and is composed of a generally C-shaped first curved portion 38, a recurved generally C-shaped second curved portion 40 extending from the first curved portion 38, and a generally C-shaped third curved portion 42 extending from the second curved portion 40. The continuous nature of the curved portions 38, 40 and 42 creates a sinuous or serpentine configuration between the upper attachment segments 30 and the lower attachment segments 32, and provides recoilable deflection for a foundation unit employing wire support members 10.

Each of the lower attachment segments 32 includes a leg 44 raised toward the curved portions 38 through 42. The purpose of the leg 44 is to assure that the lower attachment segment 32 does not become disengaged from a staple 28 when compressive force is applied to the foundation unit.

As explained above and in greater detail in U.S. Pat. No. 4,377,279, when employed in a foundation unit, a series of wire support members 10 are located in a plurality of spaced, parallel rows of the support members. Each of the rows of support members extends substantially between the opposite sides of the foundation unit and lies essentially in a single plane, so that the foundation unit can be closed. A series of stabilizing struts may be used to maintain the foundation unit in the raised orientation (illustrated in FIG. 1) or other means may be employed as desired. For example, a series of wire support members 10 may be side supports which are secured to the perimeter border member 16, transverse to the parallel rows of support members, for maintaining the foundation unit in an upward orientation. For shipping purposes, these latter support members can be folded against the grid wire top bearing structure 12 and remain unattached to the longitudinal side slats 24 until final assembly of the foundation unit, at which time the lower attachment segments 32 of the support members would be stapled to the side slats 24 in a fashion identical to that of the support members 10 illustrated in FIG. 1.

Often, the most difficult location to support in a foundation unit is a corner thereof. A wire support member 10' according to the location can be used to support the corner of a foundation unit, as illustrated in FIG. 3. The wire support member 10' is identical to the support member 10 described above, except that the two sinuous central segments 46 and 48 of the support member 10' are oriented at right angles to one another. To accomodate the orientation of the central segments 46 and 48, the upper attachment segments 30 are bent at the limits 36, forming an obtuse angle between the link 34 and each of the segments 46 and 48. If the support member 10' is symmetrical, the obtuse angle formed between the link 34 and each of the central segments 46 and 48 is 135°.

As illustrated in FIG. 3, the support member 10' is secured to the perimeter border member 16 by a pair of clips 26. The clips 26 are normally affixed to the segments 30 adjacent the limits 36 so that the link 34 extends essentially between the clipped locations of the support member 10'. The support member 10' is also secured to an end slat 46 of the bottom substructure 14 by a pair of staples 28.

In all forms of the invention, in order to promote symmetry, it is preferred that each half of the support members 10 or 10' be a mirror image of the other half. With reference to FIG. 2, the right hand portion of the support member 10 is a mirror image of the left hand portion thereof, if a vertical section were taken to split the support member 10 vertically in half.

The wire support member 10 is intended to replace typical coil springs found in a foundation unit. If desired, the support member 10 can be also used in combination with coil springs or other similar support members, such as those disclosed in U.S. Pat. No. 4,377,279. Various changes can be made to the invention without departing from the spirit thereof or scope of the following claims.

What is claimed is:

1. A wire support member for a foundation unit of the type having a grid wire top bearing structure and a rigid bottom substructure, comprising a pair of spaced wire elements of generally circular cross-section and arranged in mirror image to one another, and comprising a. a pair of upper attachment segments, and a generally straight link joining said segments as a continuous element, b. a pair of sinuous central segments extending from opposite ends of said upper attachment segments, each of said sinuous central segments including i. a generally C-shaped first curved portion, and ii. an oppositely facing generally C-shaped second curved portion extending from said first curved portion, and a third curved portion extending from said second curved portion and c. a lower attachment segment, parallel to a respective upper attachment segment, connected to each sinuous central segment, each said sinuous central segment extending between said upper attachment segment and an associated lower attachment segment, d. said upper and lower attachment segments and said central segments being situated in a generally planar configuration with said lower attached segments being unattached to one another and said spaced from one another.

2. A wire support member according to claim 1 in which each said third curved portion is a generally C-shaped third curved portion.

3. A wire support member according to claim 1 in which each said lower attachment segment includes a leg raised toward said sinuous central segment.

4. A wire support member according to claim 1 in which said sinuous central segments are situated at right angles to one another.

5. In a foundation unit having a flat top bearing structure composed of spaced grid wires, the foundation unit being of determined depth and generally rectangular in shape and having opposite longitudinal end edges and opposite lateral side edges, said foundation unit further having a bottom substructure and support means intermediate the top bearng structure and bottom substructure for maintaining the determined depth, the improvement comprising a. said support means comprises a plurality of spaced, parallel rows of support memebers extending substantially between the opposite lateral side edges of the top bearing structure, and each row of support members lying essentially in a single plane, with a plurality of said rows of support members being located intermediate said end edges, b. each of rows of support members being composed of a plurality of continuous wire elements, each support member comprising a pair of wire elements arranged in mirror image to one another, and comprising i. pairs of parallel upper and lower attachment segments, said upper attachment segments being joined by a link forming said upper attachment segments into a continuous element and said lower attachment segments being unattached to one another, each upper attachmented segment being disposed beneath at least one of said grid wires, and ii. a pair of sinuous central segments extending between said upper and lower segments, each said central segment including A. a generally C-shaped first curved portion, and B. an oppositely facing generally C-shaped second curved portion extending from said first curved portion, and a third curved portion extending from said second curved portion and c. means hingedly securing said rows of support members to said top bearing structure and said bottom substructure to permit collapse of the foundation unit about said rows of support members.

6. A foundation unit according to claim 5 in which said third curved portion is a generally C-shaped third curved portion.

7. A wire support member according to claim 5 in which said lower attachment segment includes a leg raised toward said central segment.

8. A wire support member according to claim 5 including a corner element for each corner of said foundation unit, each corner element comprising a pair of said wire elements situated at right angles to one another and located at each corner of the foundation unit.

9. A wire support member according to claim 8 in which the wire elements of each corner element are connected by a common link which extends at an obtuse angle to each wire element of the corner element.

* * * * *